US005773741A

United States Patent [19]

Eller et al.

[11] Patent Number: 5,773,741

[45] Date of Patent: Jun. 30, 1998

[54] METHOD AND APPARATUS FOR NONSEQUENTIAL STORAGE OF AND ACCESS TO DIGITAL MUSICAL SCORE AND PERFORMANCE INFORMATION

[75] Inventors: Marlin J. Eller; Brent R. Mills, both of Seattle, Wash.

[73] Assignee: Sunhawk Corporation, Inc., Seattle, Wash.

[21] Appl. No.: 715,978

[22] Filed: Sep. 19, 1996

[51] Int. Cl.[6] ..... A63H 5/00; G04B 13/00; G10H 7/00

[52] U.S. Cl. ..... 84/609; 84/477 R; 84/483.1; 382/187

[58] Field of Search ..... 84/600, 601, 609, 84/634, 477 R, 484, 483.1; 382/187

[56] References Cited

U.S. PATENT DOCUMENTS

| | | | |
|---|---|---|---|
| 4,528,643 | 7/1985 | Freeny, Jr. | 364/900 |
| 4,535,356 | 8/1985 | Nakagawa et al. | 358/145 |
| 4,956,768 | 9/1990 | Sidi et al. | 364/200 |
| 4,958,551 | 9/1990 | Lui | 84/462 |
| 5,086,475 | 2/1992 | Kutaragi et al. | 381/36 |
| 5,146,833 | 9/1992 | Lui | 84/462 |
| 5,171,928 | 12/1992 | Kim | 84/609 |
| 5,239,540 | 8/1993 | Rovira et al. | 370/77 |
| 5,333,155 | 7/1994 | Dambacher | 375/122 |
| 5,400,687 | 3/1995 | Ishii . | |
| 5,402,339 | 3/1995 | Nakashima et al. . | |
| 5,404,295 | 4/1995 | Katz et al. | 364/419.19 |
| 5,406,558 | 4/1995 | Rovira et al. | 370/77 |
| 5,510,572 | 4/1996 | Hayashi et al. | 84/609 |
| 5,524,051 | 6/1996 | Ryan | 380/9 |
| 5,561,849 | 10/1996 | Mankovitz | 455/45 |

OTHER PUBLICATIONS

The International MIDI Association, *MIDI 1.0 Detailed Specification,* Version 4.1.1, Sections One and Two, pp. 1–18, Feb. 1990.

Rona, Jeffrey, *The MIDI Companion,* Chapter 6, "An Overview of MIDI", pp. 29–38, 1994.

*Primary Examiner*—William M. Shoop, Jr.
*Assistant Examiner*—Jeffrey W. Donels
*Attorney, Agent, or Firm*—Seed and Berry LLP

[57] ABSTRACT

Digital musical information for a musical score is stored in records that are established based on types of musical information or notation and are therefore independent of the musical sequence of the score. In this manner, the information for a single musical element such as a note, clef, or accent can be spread over more than one record, or information for more than one element can be included in a single record. This storage format accommodates subsequent revisions or additions to the score or accessing code, facilitates data compression for enhanced transmission rates, facilitates progressive (e.g., page-by-page) transmission and provides enhanced flexibility for implementing encryption techniques.

32 Claims, 4 Drawing Sheets

METHOD AND APPARATUS FOR NONSEQUENTIAL STORAGE OF AND ACCESS TO DIGITAL MUSICAL SCORE AND PERFORMANCE INFORMATION

FIELD OF THE INVENTION

The present invention relates generally to digital musical systems and, in particular, to a method and apparatus for storing musical information representative of a musical score and/or musical performance in defined records, and subsequently accessing the records, in a record format independent of the musical sequence.

BACKGROUND OF THE INVENTION

Digital musical systems are used to store musical scores so that the musical scores can subsequently be displayed or played back as desired by a user. Storing the musical score involves representing the musical score as digital information and recording the digital information in storage records that can be retrieved and used by a display or playback program ("accessing program").

In order to fully represent the musical score, the digital information must represent musical information of various types. For example, to fully display a musical score, information must be provided that represents the heads, stems, flags and the like for the various notes of the musical score in addition to information representing the clef, staff, time and the like for the score. Playback involves information concerning pitch, timing, sequence, timbre, track, etc. for each note or time interval of the score. The full representation of a musical score therefore involves a substantial amount of digital information.

This information is organized into records in a format that is compatible with the accessing program. Conventionally, the storage format of digital musical systems corresponds to the musical sequence. That is, the information for a single element such as a note is kept in a single record and the resulting records are organized and accessed in the sequence of the elements in the musical score. This storage format, has been viewed as natural and optimal by many because the accessing program can simply retrieve a single record and all of the information necessary for the element is available. In many respects, display or playback is a simple process in digital musical systems using a sequential storage format.

SUMMARY OF THE INVENTION

It has been recognized that digital musical systems employing sequential storage formats can be problematic in operation. In particular, such systems are somewhat intolerant to changes or additions to the music or musical notation. The case of adding accent marks to the system's capability is illustrative. In a conventional sequential storage format, one would need to add a new field to the records of the accented notes, i.e., the accent field. However, since the accessing program is not programmed to handle this field, new code needs to be added to read and use such information. When the code is changed, the old records become obsolete unless the code accommodates the complications of backwards compatibility to read multiple formats. Such fragility is highly undesirable in the business context of publishing digital music files and distributing access code, for example, across a communications network.

The present invention implements a nonsequential digital music format that is more robust in relation to musical additions or changes. Data records are established by reference to types of musical information rather than sequence. The information for a particular element can therefore be stored in multiple records, where the information for the element in the various records is interlinked in a manner that allows for coordinated access. A musical score can be modified using this format by simply adding a record—for example, an accent record including accent information for all accented notes—without the complications of obsolete records or new code for backwards compatibility. A specialized type of relational database is thereby defined for formatting digital musical information.

This relational format provides a number of other advantages. First, the relational format facilitates data compression. Certain compression schemes will compress adjacent similar objects in a data format more than adjacent dissimilar objects. Compression is therefore enhanced by collecting similar types of musical information in designated records rather than storing information as a function of musical sequence. The relational format also facilitates progressive transmission. Over slower networks like the Internet, it can take as long as a few minutes to download a musical score. Using the relational format, the records for the various types of musical information can be made to correspond to a page of a musical score.

A server can therefore transmit, and a client can display all of the information for individual pages of the musical score without waiting to receive the entire file. Such records make suitably sized compressible chunks for progressive transmission.

Relatedly, the information can be encrypted on a page-by-page basis. For example, all but the first page of a musical score may be encrypted to allow the client to sample the music before purchasing. The relational format therefore provides flexibility in implementing encryption techniques.

According to one aspect of the present invention, a method is provided for nonsequentially storing digital information representative of a musical score, i.e., a musical composition or any portion thereof. The method includes the steps of determining a number of types of information for collectively defining particular elements (e.g., notes, clefs, accents or other musical elements or portions thereof) of the musical score where the elements are sequentially related with respect to the musical score; establishing a record corresponding to each of the types of information; and, for each element of the musical score, storing information for defining the element in the appropriate records. In the case of a musical display system, separate records may be established for various defined objects, where a set of one or more objects define a musical element. By way of example, where the musical element is a note, the various tables may include object information concerning each of: (1) the note head, (2) the note stem, and (3) the note flag. Such records may be represented in multiple table or matrix form where one column of each table includes object identifier information, and rows contain information pertaining to one of the head, stem, or flag of a single note as well as information for explicitly linking the object to related objects. It will thus be appreciated that the information for a single element can be stored in multiple records such that the records are independent of element sequence. Moreover, information regarding multiple elements can be included in a single record. The total number of records is therefore independent of, and may be less than, the number of elements. A corresponding apparatus includes a memory controlled by appropriate record generating logic to store the multiple records and a controller for use in selectively writing the musical score information into the appropriate records on an element-by-element basis.

According to another aspect of the present invention, nonsequentially stored elements of a musical score are accessed by an access program to reconstruct the musical score. The access program operates in conjunction with a nonsequential storage format as described above. To display or play back the musical score, the access program proceeds in a sequence corresponding to the sequence of the elements in the musical score. For a particular element, the access program retrieves. information from more than one defined record. This retrieval process can be coordinated by explicit interlinking of corresponding data from the various records. For example, where the records are represented by tables including information for linking related objects that collectively define a musical element, the access program can be programmed to access information from a number of tables associated with a particular element. The accessed information can then be used by the access program to display or play back the element. A corresponding apparatus includes a memory controlled by appropriate record generating logic to store the multiple records and a controller for selectively reading the musical score information from the appropriate records on an element-by-element basis.

The present invention thus provides a method and apparatus for nonsequentially storing and accessing digital musical information. The invention is robust in relation to modifications or additions to musical score and reduces or substantially eliminates the complications of obsolete records or code for reading multiple formats for backwards compatibility. Moreover, the invention facilitates data compression and progressive transmission of data, and allows for greater flexibility in implementing encryption techniques.

BRIEF DESCRIPTION OF THE DRAWINGS

For a more complete understanding of the present invention and further advantages thereof, reference is now made to the following detailed description taken in conjunction with the drawings in which.

DETAILED DESCRIPTION OF THE INVENTION

In the following description, the invention is set forth in the context of a system for accessing music over a public network. The invention is particularly advantageous in such applications because of the data compression, progressive transmission and encryption characteristics described above. However, it will be appreciated that the invention is advantageous for a variety of public or private digital music applications such as distribution of music stored on CD-ROM or other media, particularly applications where it may be desired to allow for editing of musical scores, to allow for interactive arrangement or enhancement of musical scores, or where the musical scores and/or accessing program may otherwise evolve or change over time.

Figure 1:
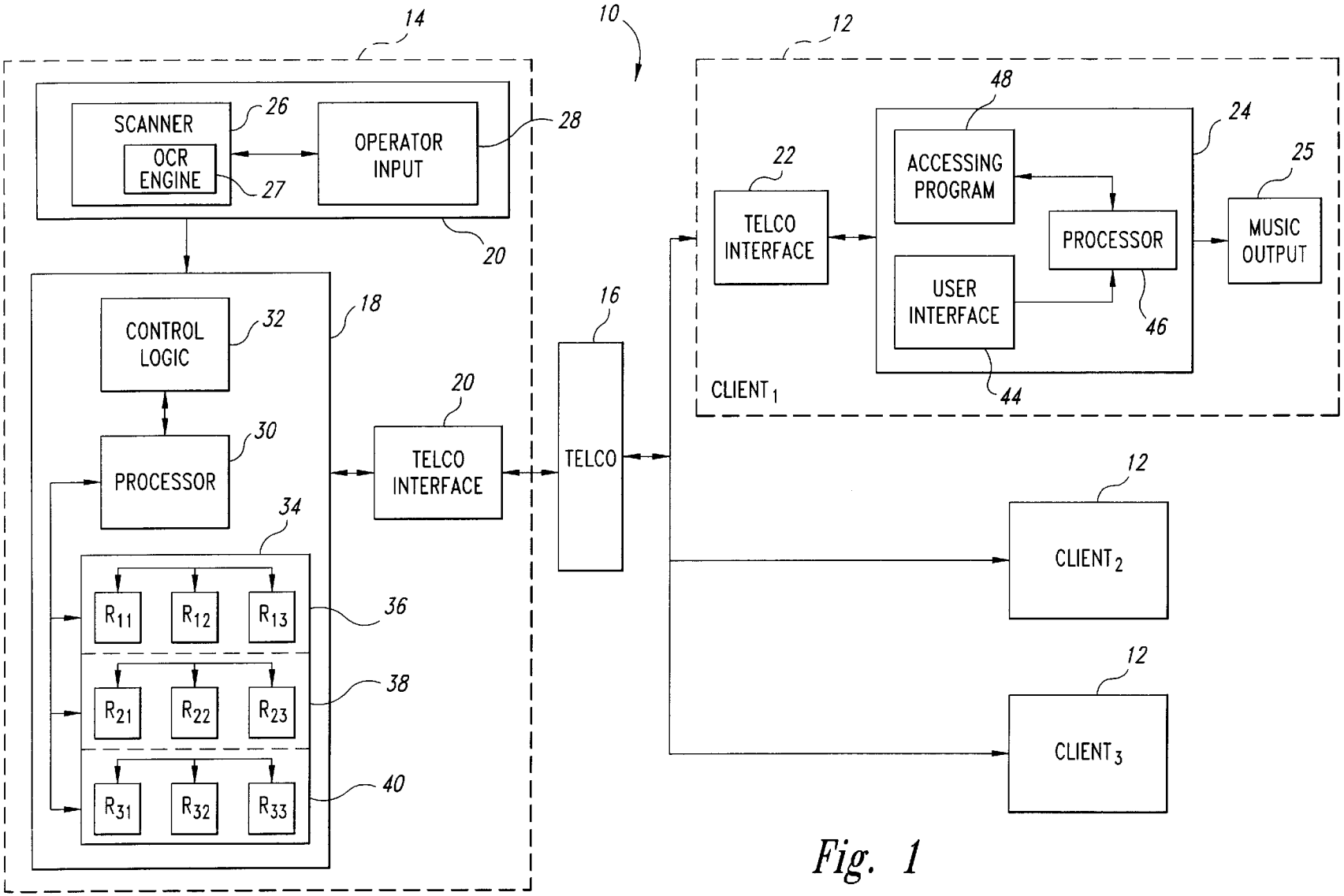
FIG. 1 is a schematic diagram of a music storage and distribution system according to the present invention.

FIG. 1 schematically illustrates a music storage and distribution system 10 according to the present invention. The system 10 allows network client nodes 12 to access music available from a system server node 14 via a public or private telecommunications network (TELCO) 16. For the purposes of this description, the client nodes 12 of illustrated $CLIENT_1$-$CLIENT_3$ may be considered to be identical. On the server side, the system 10 generally includes a controller 18 for storing and controlling access to a library of musical scores, an input device 20 for entering and editing digital musical scores and a server TELCO interface 20 which may include a modem or direct line access. Each network client node 12 includes a client TELCO interface 22, a controller 24 and a music output device for displaying, printing and/or playing back the musical score. Communication between the server and client may be accomplished via the Internet or other network capable of supporting multimedia functions for displaying and playing musical scores. In the case of the Internet, the server node 14 is preferably accessed via the NETSCAPE 2.01 or MICROSOFT INTERNET EXPLORER 3.0, or higher, browsers.

Musical scores are entered into the controller 18 by input device 20 as digital information. Any suitable digital input device can be used in this regard. For example, sheet music can be digitized by a scanner 26, such as a RICOH production scanner, associated with controller 18. Musical scores can also be entered or edited manually by the operator using an operator input device 28 such as a music editor program that receives instructions via a keyboard, mouse or the like. Digital musical information can also be received in the Musical Instrument Digital Interface (MIDI) format from a variety of MIDI devices such as computers or musical instruments.

The controller 18 receives the digital musical input, analyzes the input and stores musical scores in a novel relational database musical storage format. The illustrated controller 18 includes a processor 30 such a microprocessor, control logic 32 and a memory 34. The control logic 32 serves a number of functions including analyzing the digital musical input, directing storage of musical scores and handling access requests by users. With regard to input from scanner 26, the scanner 26 is associated with an optical character recognition (OCR) engine 27 to generate a number of record types for objects of the musical score in cooperation with operator input 28. The objects recognized by the OCR engine 27 in the illustrated system 10 are based on standard musical notation and include staffs, clefs, accent marks, note heads, stems, rests, etc.

The OCR engine 27 generates records that include information of the same type for related objects of the musical score. In this regard, it will be appreciated that the selected objects can be defined in a variety of ways. In some cases, it has been found useful to divide a single notational element into multiple objects. For example, a single note may be considered as being composed of objects corresponding to a note head, a stem, and a flag. The information for a single note can thus be stored in a number of separate records. These records are preferably explicitly interlinked to facilitate storage and retrieval of related information. Because each of these records includes information for multiple notes of a musical score, it will be appreciated that the records are nonsequential with respect to the musical score. The length of the records can be selected to correspond to a page of sheet music so as to facilitate progressive transmission and enhanced encryption options.

These records can be represented in table form such as the following tables that store information regarding the stems and note heads of various notes of a page of a musical score:

STEM TABLE

| Object ID | Stem Length | Stem Weight |
|---|---|---|
| : | | : |
| 17 | 10.8 mm | thin |
| 92 | 9.0 mm | bold |
| : | | : |

NOTE HEAD TABLE

| Object ID | Head Type | Related Stem | Related Staff | Staff Location |
|---|---|---|---|---|
| : | | | | : |
| 26 | solid | 17 | 231 | 1st line |
| 15 | hollow | 92 | 7 | 3rd space |
| 4 | solid | 17 | 231 | 2nd line |
| : | | | | : |

Similar tables are provided to store information concerning flags and the like. The relationships between objects are kept as fields that join thereby explicitly linking related objects that collectively define a musical element. Thus, in the above example, note head number 26 is related to stem number 17, meaning that stem number 17 is the stem for note number 26. Stem number 17 is also the stem for note number 4. It will be appreciated that such records of similar types of information can be readily compressed for improved transmission speeds. A sequencing record can be used to define the sequence timing of the objects or their associated musical elements.

Similar records can be generated for other types of digital musical input. For example, a MIDI input data stream is structured in a sequentially time stamped format that is defined by an industry standard. A number of products are commercially available to generate sheet music from such MIDI input by deriving notational information from the input based on the defined standard. Such information can be translated into the multiple record format of the present invention by control logic 32.

Any convenient number of records can be used to store a musical score. FIG. 1 schematically illustrates a memory 34 storing three musical scores, 36, 38, and 40. Although the actual number of records would typically be greater in operation, each of the musical scores 36, 38 or 40 is illustrated as including three interlinked records $R_{11}$, through $R_{33}$. For purposes of illustration, the stem table and note head table set forth above may be considered as comprising records $R_{11}$, and $R_{12}$.

The controller 24 of client node 12 includes a user interface 44 such as a keyboard or mouse and a processor 46 which may be a microprocessor. To select and access a musical score 36–40 stored in memory 34, a user operates client interface 44 to call controller 18 via TELCO and TELCO interfaces 20 and 22, for example, using the Internet. Upon receiving the call from the client, the control logic 32 implements a program that prompts the client to select a desired musical score from the library stored in memory 34. Preferably, the program operates on a graphical user interface operating system such as WINDOWS 95, manufactured by Microsoft, Inc. The control logic 32 may also prompt the client to enter payment information for any selected musical scores and, in the case of credit card payments, contact the appropriate approval service of the credit card company for credit approval. In addition, the control logic 32 preferably implements an encryption function to encrypt all or selected pages of the musical score until payment has been received. For example, because the records $R_{11}$–$R_{33}$ in the illustrated system 10 are kept on a page-by-page basis, all but the first page of a score may be encrypted to allow the client to sample a score prior to payment. The music data is preferably compressed prior to transmission for improved transmission rates.

In order to play and display a selected musical score, the controller 24 of client node 12 can be provided with a compatible accessing program 48. The accessing program 48 can be downloaded from the server's web site or can be provided separately. The accessing program 48 receives the complete set of records for the selected musical score in the relational database format, reconstructs the musical score by selectively accessing the digital information recorded in the records, and outputs information for use in driving the music output device 25. The score information may be progressively transmitted and displayed/played on a page-by-page basis. In order to reconstruct the score, the accessing program 48 is guided by a sequencing record, relating musical elements and/or object identification codes to corresponding time or score location information, and a system clock. The program 48 thus proceeds element-by-element to output element related information at appropriate sequence intervals. For a particular element, the program 48 accesses information from the various records associated with the related object identification codes using conventional relational database techniques. This information, which provides a description of the element sufficient for playback and display, can then be translated into an appropriate format, such as the MIDI format, to operate an output device 25 with the aid of device drivers.

One advantage of the relational database digital music storage format of the present invention is that the system 10 is robust in relation to changes in the musical scores 36–40. For example, if it is desired to edit a musical score 36 by adding accents to particular notes, a new record, e.g., $R_{13}$, can be added as indicated by the following table:

ACCENT TABLE

| Object ID | Related Note | Accent Type |
|---|---|---|
| : | | |
| 391 | 26 | Downward Arrow |
| : | | |

The addition of the new record will not prevent proper operation of the accessing program 48. The code of program 48 does not need to be changed as it is still just reading tables. If the program 48 does not include code for displaying the added accents, it will simply ignore the table that it does not understand and display the score without accents. The accessing program 48 also allows users to change the color of the displayed notes, the page layout and tempo during playback as well as allowing scores to be played back using various instruments. Additionally, playback and display can be coordinated, if desired, to allow notes to be lighted as they are played or provide other effects for enhanced enjoyment. The present invention thus provides a way of distributing musical scores and accessing programs while allowing both to evolve without the problems of obsolete file formats or backwards compatibility coding.

Figure 2:
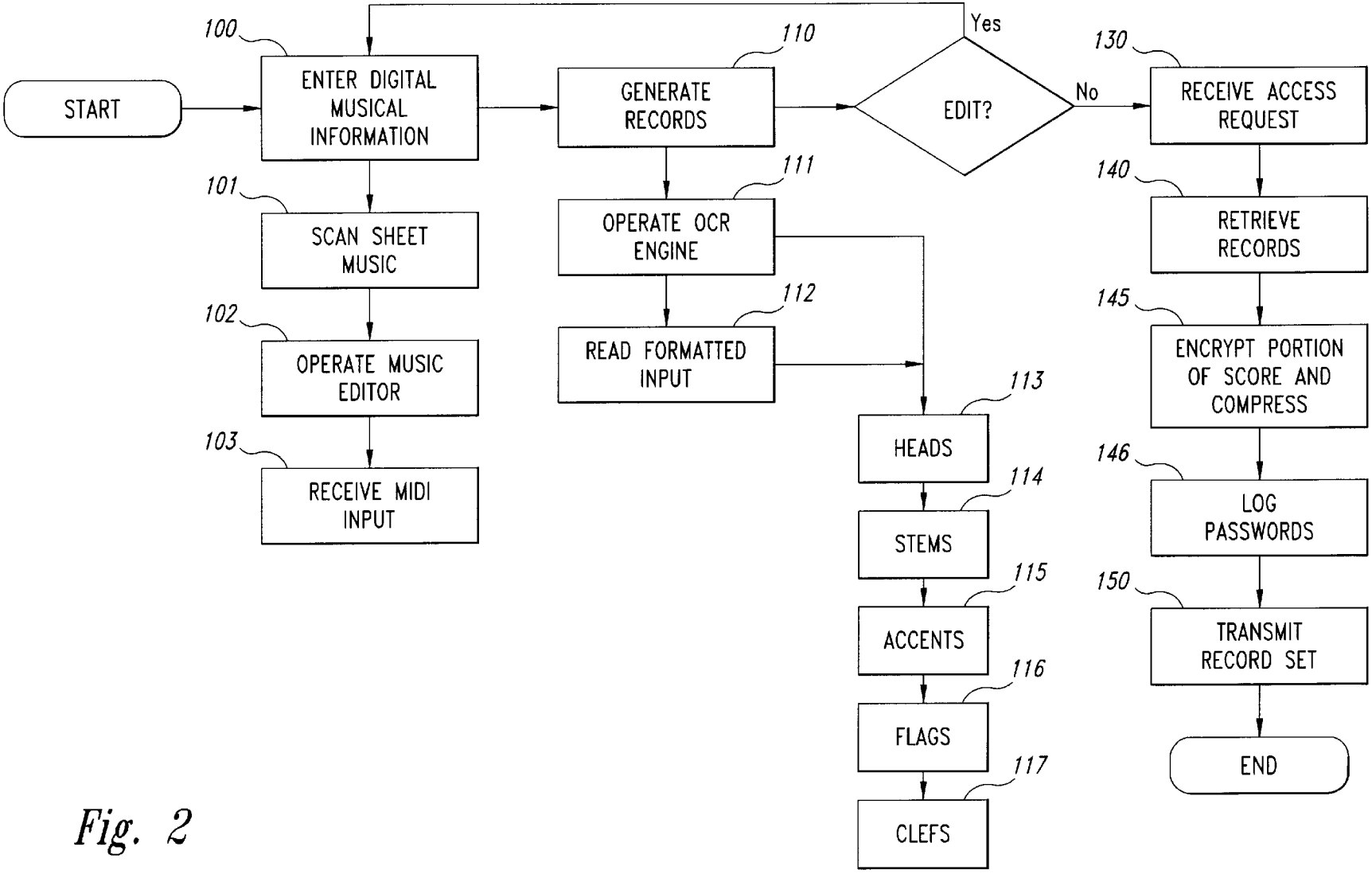
FIG. 2 is a flowchart illustrating operation of a server node of the system of FIG. 1 for music storage and transmission.

The operation of the server node may be summarized by reference to FIG. 2. Storage of a musical score is initiated by entering (100) digital information representing the score. As previously noted, the information can be entered in various ways including by scanning (101) sheet music, by operating (102) a music editor program or by receiving (103) input from a MIDI device. The digital information is then used to generate (110) records in a relational database format. For example, the records can be generated from scanner input by operating (111) an OCR engine. In the case of input from a MIDI device, music editor or the like, the records can be generated by reading (112) the formatted input and extracting the relevant information. Separate records are thereby generated for selected object groups such as noteheads (113), stems (119), accents (115), flags (116), clefs (117), etc.

At any time after a score has been entered, it may be desired to edit (120) the score. Editing can be accomplished by entering (100) additional digital musical information, for example, by operating (102) the music editor. Upon receiving (130) an access request from a client, the controller of the server node retrieves (140) the records for the score selected by the client. The server then encrypts a portion of the score and compresses the data (145), logs passwords (146) for allowing an authorized client (e.g., after payment) to decrypt the data, and transmits (150) the record set to the client node terminal on a page-by-page basis. The partially encrypted (145) file for the musical score may be transmitted prior to payment for preview by the client. Alternatively, the record set can be stored and distributed in CD-ROM form or other media rather than distributed over a network.

Figure 3:
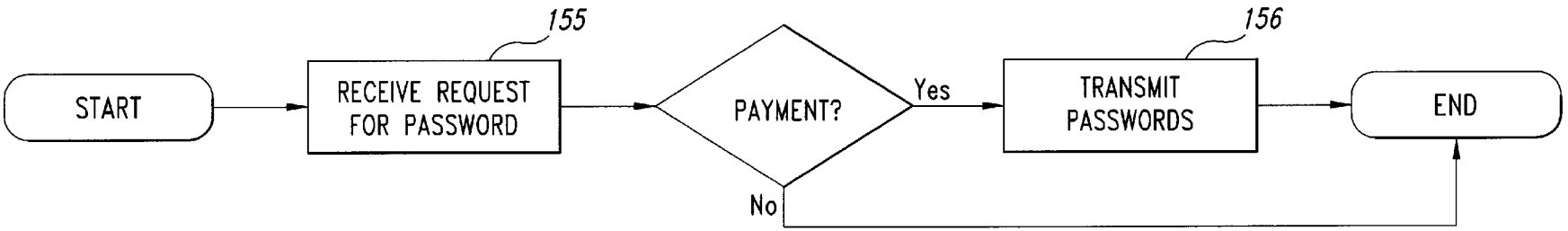
FIG. 3 is a flowchart illustrating operation of a server node of the system of FIG. 1 for payment verification and password transmission.

FIG. 3 shows the process for issuing a decryption password or key upon receiving payment. In the illustrated system, all scores are at least partially encrypted when sent to the client. As a separate server side service, passwords are sold to clients. In this regard, the server receives (155) a request for password and selectively transmits (156) a password depending on whether payment is received (e.g., by receiving payment information from the client and/or approval from a credit card service). In order to prevent unauthorized copying of the scores, the scores are preferably not saved on the client system in their decrypted form. Rather, they are decrypted Just In Time (JIT) in memory in preparation for playback or rendering printed output.

Figure 4:
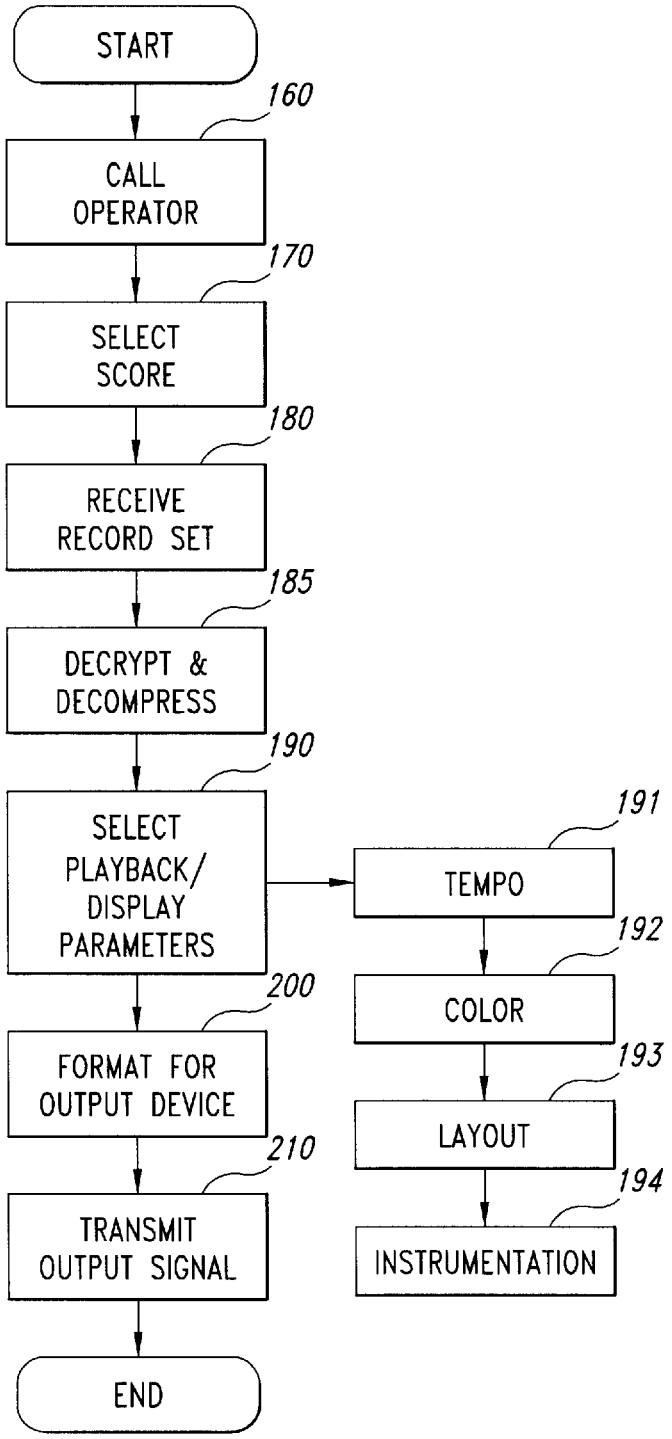
FIG. 4 is a flowchart illustrating operation of a client node of the system of FIG. 1.

FIG. 4 summarizes operation of the client node terminal. The client initiates a transaction by calling (160) the server node, e.g., via the Internet using a suitable browser. Once connected, the client responds to prompts from the server to view selection options, enter any required payment and identification information and select (170) a musical score. The client will then receive (180) and decrypt and decompress (185) the record set for the selected score and can select (190) parameters for playback and display of the score. Among the parameters that may be defined by the client are playback tempo (191), display color (192) and layout (193) as well as playback instrumentation (194). It will be appreciated that many other parameters may be supported. The musical score information is then formatted (200) for use by the output device and associated drivers and the formatted score information is transmitted (210) as an output signal.

While various aspects and embodiments of the present invention have been described in detail, it is apparent that further modifications and adaptations of the invention will occur to those skilled in the art. However, it is to be expressly understood that such modifications and adaptations are within the spirit and scope of the present invention.

We claim:

1. A method for use in processing a musical score in a computer system, comprising the steps of:

identifying a plurality of types of information for use in collectively defining particular elements of said musical score, said elements being sequentially related with respect to said musical score, wherein each of said plurality of types of information is common to more than one of said elements of said musical score;

establishing a first record in said computer system, said first record including first information of a first of said types regarding a first of said elements;

establishing a second record in said computer system, said second record including second information of a second of said types regarding said first element; and explicitly linking said first information from said first record regarding said first element to said second information from said second record regarding said first element so as to allow for coordinated access to said first and second information regarding said first element.

2. The method of claim 1, further comprising the step of accessing said first and second records to retrieve said musical score.

3. The method of claim 2, further comprising the step of providing a visual display based on said retrieved musical score.

4. The method of claim 2, further comprising the step of operating a musical device to produce music based on said retrieved musical score.

5. The method of claim 1, further comprising the step of establishing additional records, each including additional information regarding elements of said musical score, wherein said first record, second record and additional records comprise a records database defining said musical score.

6. The method of claim 5, further comprising the step of revising said musical score by adding a record to said database.

7. The method of claim 5, wherein a number of records in said records database is different than a number of elements in said musical score.

8. The method of claim 5, wherein a number of records in said records database is less than a number of elements in said musical score.

9. The method of claim 1, wherein said elements comprise elements of standard musical notation.

10. The method of claim 1, wherein said musical elements comprise notes of said musical score and each of said first and second records includes information regarding only one of a note head, a note stem, a note flag and a note accent.

11. The method of claim 1, wherein said information of a first type comprises note head information and said information of a second type comprises note stem information.

12. The method of claim 1, wherein said step of explicitly linking comprises relating said first information to said second information in a relational database.

13. The method of claim 1, wherein said step of identifying a plurality of types of information comprises defining each of said elements as a plurality of component objects.

14. The method of claim 1, further comprising the step of scanning a sheet of music so as to obtain a digital representation of said sheet of music suitable for processing as said musical score in said computer system.

15. The method of claim 14, wherein said first and second records are established by analyzing said digital representation of said musical score using an optical character recognition engine.

16. The method of claim 1, wherein said first and second records are entered in said computer system by employing a music editor.

17. A computer system for processing digital musical scores, comprising:

computer storage means controlled so as to store a musical score as a plurality of interrelated records, including;

a first record comprising information of a first type for elements, including a first element of said musical score;

a second record comprising information of a second type for elements including said first element of said musical score;

wherein first information from said first record regarding said first element is explicitly linked to second information from said second record regarding said first element; and access means operative for selectively accessing said computer storage means so as to retrieve said first information from said first record and said second information from said second record.

18. The system of claim 17, wherein said storage means comprises a computer memory associated with control logic for storing said musical score.

19. The system of claim 17, further comprising input means for entering said musical score as digital information in said computer storage means.

20. The system of claim 19, wherein said input means comprises an optical scanner.

21. The system of claim 20, wherein said input means comprises an optical character recognition engine associated with said scanner.

22. The system of claim 19, wherein said input means comprises a music editor.

23. The system of claim 17, wherein said access means is operative for communicating with said storage means via a network.

24. A method for processing a digital musical score, said digital musical score including first and second musical elements where said first element comes prior to said second element in a musical sequence of said musical score, said method comprising the steps of:

receiving a file of digital information representing said digital musical score, said file including first and second records wherein said first and second records are established independent of said musical sequence of said musical score;

obtaining first element information regarding said first element from each of said first and second records;

obtaining second element information regarding said second element from each of said first and second records; and reproducing said musical score using said first element information and said second element information, wherein said first element and second element are reproduced in said musical sequence of said musical score.

25. The method of claim 24, wherein said step of receiving comprises downloading said file from a server.

26. The method of claim 24, wherein each of said steps of obtaining first element information and obtaining second element information comprises accessing related information from a relational database.

27. The method of claim 24, wherein said step of reproducing comprises visually displaying said musical score.

28. The method of claim 24, wherein said step of reproducing comprises playing back said musical score.

29. A method for use in processing a digital musical score, comprising the steps of:

determining a number of types of information for collectively defining particular elements of said musical score where said elements are sequentially related with respect to the musical score;

establishing a record corresponding to each of said types of information, wherein said records are established independent of a musical sequence of said musical score; and for each element of said musical score, storing element information for defining said element in said records, whereby said musical score is stored in a nonsequential format.

30. The method of claim 29, wherein said records include a first record comprising display information regarding a first portion of a first of said elements and a second record comprising display information regarding a second portion of said first of said elements.

31. The method of claim 29, wherein said step of establishing a record corresponding to each of said types of information comprises defining said record so as to correspond to a single page of sheet music, thereby allowing for progressive transmission.

32. The method of claim 1, wherein said first and second records are adapted for editing by a music editor.

* * * * *